US008622239B2

(12) United States Patent
Alvares et al.

(10) Patent No.: US 8,622,239 B2
(45) Date of Patent: Jan. 7, 2014

(54) RIB AND GASKET ARRANGEMENT FOR A CAN

(75) Inventors: Antonio Carlos Teixeira Alvares, Sao Paulo (BR); Pedro Bruni Labate, Sao Paulo (BR); Manoel Jose Guarda, Sao Paulo (BR)

(73) Assignee: Brasilata S.A. Embalagens Metálicas, Sao Paulo (BR)

( * ) Notice: Subject to any disclaimer, the term of this patent is extended or adjusted under 35 U.S.C. 154(b) by 903 days.

(21) Appl. No.: 11/969,298

(22) Filed: Jan. 4, 2008

(65) Prior Publication Data

US 2009/0114663 A1 May 7, 2009

(30) Foreign Application Priority Data

Nov. 1, 2007 (BR) ..... 018070072842

(51) Int. Cl.

| | |
|---|---|
| ***B65D 25/28*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |
| ***B65D 25/10*** | (2006.01) |
| ***B65D 53/00*** | (2006.01) |
| ***B65D 81/24*** | (2006.01) |
| ***B65D 39/00*** | (2006.01) |
| ***B65D 41/18*** | (2006.01) |
| ***B65D 41/16*** | (2006.01) |
| ***B65D 23/10*** | (2006.01) |

(52) U.S. Cl.

USPC ..... 220/759; 220/212.5; 220/669; 220/671; 220/754; 220/793; 220/795; 215/396

(58) Field of Classification Search

USPC ..... 220/669, 671, 754, 763, 212.5, 795, 220/752, 756, 759, 769, 791, 793; 215/396

See application file for complete search history.

(56) References Cited

U.S. PATENT DOCUMENTS

| | | | | |
|---|---|---|---|---|
| 1,700,958 | A * | 2/1929 | Staunton | 215/262 |
| 4,386,715 | A * | 6/1983 | Morton | 220/798 |
| 5,590,802 | A * | 1/1997 | Mitchell | 220/321 |
| 5,842,593 | A * | 12/1998 | von Holdt | 220/212.5 |
| 5,988,417 | A * | 11/1999 | Cheng et al. | 215/383 |
| 2008/0173655 | A1 * | 7/2008 | Navarro | 220/754 |

* cited by examiner

*Primary Examiner* — Anthony Stashick
*Assistant Examiner* — Andrew T Kirsch
(74) *Attorney, Agent, or Firm* — Fish & Richardson P.C.

(57) ABSTRACT

Improvement in a can of the type which comprises: a body portion; a neck portion of reduced contour and having an upper end edge provided with an outer peripheral projection and defining the contour of an upper opening; a transition portion joining the body portion and the neck portion; and a lid having a peripheral tubular portion to be fitted in the interior of the upper opening of the neck portion and having a free upper edge carrying an outer circumferential rib under which is applied an annular gasket to be seated onto the upper outer edge of the neck portion upon the fitting of the lid in the upper opening. The transition portion may externally incorporate, in a single piece, a plurality of spaced apart longitudinal ribs joining the transition portion to an adjacent lower region of the neck portion.

11 Claims, 7 Drawing Sheets

RIB AND GASKET ARRANGEMENT FOR A CAN

FIELD OF THE INVENTION

The present invention refers to an improvement applied to a can formed in metallic sheet and comprising a tubular body portion, generally presenting a circular section and carrying a bottom wall, an upper neck portion with a contour smaller than that of the body portion, and a transition portion joining the body portion and neck portion and having an end edge which defines the contour of an upper opening for the can, on which is fitted a removable lid.

PRIOR ART

There are well known from the prior art the tubular cans obtained in metallic sheet and comprising a body portion, of circular or polygonal cross-section and carrying a bottom wall and an annular upper wall which are peripherally attached, generally by double-seaming, to the lower end edge and upper end edge of the can. This type of construction, which is well known in the art, allows the bottom wall and the annular upper wall to exert a function of structuring the body portion of the can, without requiring the incorporation of additional stiffening structural elements. This type of can has the body portion presenting a cross-section which is constant or progressively reduced from the bottom wall to the annular upper wall, the thickness of the metallic sheet being dimensioned as a function of this structural configuration of the can.

There are also known cans which present a body portion of tubular section inferiorly carrying the bottom wall and which is superiorly joined, through a transition portion, to a neck portion of smaller contour, in whose free upper end edge is double-seamed at the peripheral edge of an annular upper wall.

In the can construction in which the body portion extends from one end edge to the other with the same cross-section, the provision of the annular upper wall is fundamental for obtaining the adequate structural resistance of the can, through a metallic sheet of adequate minimum thickness. Without the annular upper wall, the thickness of the metallic sheet of the body portion would have to be considerably increased, with the consequent increase in the cost of the raw material and in the weight of the can.

On the other hand, in cans comprising a body portion and a neck portion of reduced cross-section and height, joined by a frusto-conical or frusto-pyramidal transition portion only slightly spaced from the upper end edge of the can, the provision of the transition portion in the upper region of the can provides a substantial increase in the structural resistance of the latter, allowing eliminating the annular upper wall, with the upper opening of the can corresponding to the inner cross-section of the neck portion. In this construction, it is enough that the upper end edge of the can, i.e., of the neck portion, be bent or otherwise worked to form a curl or outer peripheral projection, surrounding the upper opening of the can and defining, jointly with the upper end edge of the latter, a seat for seating a removable lid, comprising a panel portion which incorporates a peripheral tubular portion to be tightly fitted, with interference, in the upper opening, in the interior of the neck portion, said peripheral tubular portion having a free upper edge which is bent, or otherwise worked, to form a curl or outer circumferential rib, to be seated onto the upper end edge of the can, upon the closing of the lid.

This prior art construction allows eliminating the annular upper wall and forming an initial tubular body, with a metallic sheet of usual thickness, for example from about 0.21 mm to about 0.27 mm for 3.6 liter cans, and presenting a cross-section corresponding to that of the neck portion. Subsequently, said tubular body is submitted to an expansion operation, through which are formed the transition portion and the body portion, the latter presenting a concentric cross-section, similar and larger than that of the neck portion. Thus, it is possible to obtain a can with less metallic sheet consumption.

In spite of the above-mentioned advantages for cans provided with a neck portion of reduced section and without an annular upper wall, this prior art construction presents the drawback of not guaranteeing a high and reliable tightness degree in the closure of the lid.

Another inconvenience of the can with a neck of the type cited above results from the fact that the transition portion, particularly the junction region of the latter with the neck, which presents a cross-section in the form of a radially outward-facing concave arc, reduces the can resistance to the compression axial forces, in the filling line, upon the closure of the lid or the mounting of a seal and suspension ring, in the cases in which the latter is provided. The more the cross-section contour of the neck portion is reduced in relation to the body portion, for a given height of the transition portion, the more accentuated will be the structural fragility of the can against compression axial forces. This deficiency also restrictively affects the structural resistance upon stacking.

SUMMARY OF THE INVENTION

On account of the drawbacks above, it is desired to obtain a can of the type considered above which, according to an object of the present invention, presents a high tightness degree in the lid closure, even admitting higher dimensional tolerances in the formation of the upper opening of the neck portion and of the lid.

A complementary object of the invention is to provide a can as defined above which presents by using a metallic sheet of an adequate minimum thickness for the body portion, the transition portion and the neck portion, a higher resistance against compression axial forces.

A further object of the present invention is to provide a can as defined above which, besides presenting a high tightness degree in the lid closure and having higher resistance against compression axial forces, can receive a seal ring that is capable to axially retain the lid closed until the occurrence of an evidenced first opening, as well as to carry a retractable suspension handle.

These and other objects of the invention are attained by the provision of a can of the above-defined type, comprising: a body portion carrying a bottom wall; a neck portion, with a reduced section and having an upper edge incorporating an outer peripheral projection defining the contour of an upper opening of the can; a transition portion joining the tubular body portion and the neck portion; and a lid formed by a panel portion incorporating a peripheral tubular portion to be tightly fitted, with interference, in the upper opening of the can, in the interior of the neck portion, and having a free upper edge provided with an outer circumferential rib, to be seated onto the upper end edge of the neck portion.

According to the improvements, the outer circumferential rib of the lid inferiorly carries an annular gasket, for example a resin washer, to be seated onto the upper end edge of the neck portion upon the lid fitting on the upper opening.

Still according to the improvements, the transition portion can externally incorporate, in a single piece with the metallic sheet, a plurality of spaced apart longitudinal ribs joining the transition portion to an adjacent base region of the neck portion.

The construction generically defined above allows the lid closure, with the provision of the annular gasket, to present a high tightness degree, and the structural resistance in relation to the compression axial forces can be considerably increased by the provision of the longitudinal ribs in the transition portion.

BRIEF DESCRIPTION OF THE DRAWINGS

The invention will be described below, with reference to the enclosed drawings, given by way of example of a possible embodiment of the invention and in which.

DESCRIPTION OF THE INVENTION

Figure 1:
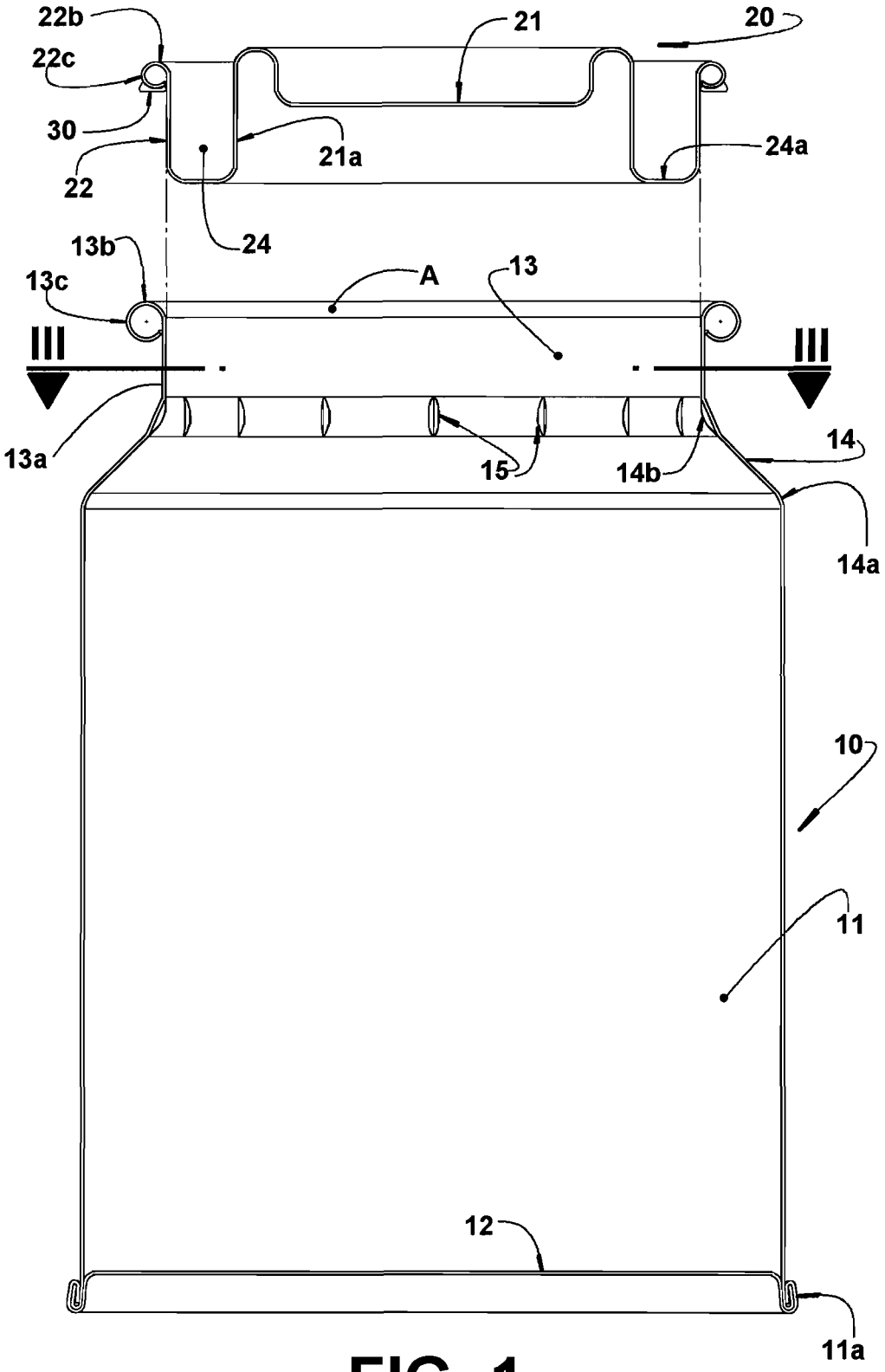
FIG. 1 represents a longitudinal sectional view of a can constructed according to the invention and having the lid in an open condition.
Figure 1A:
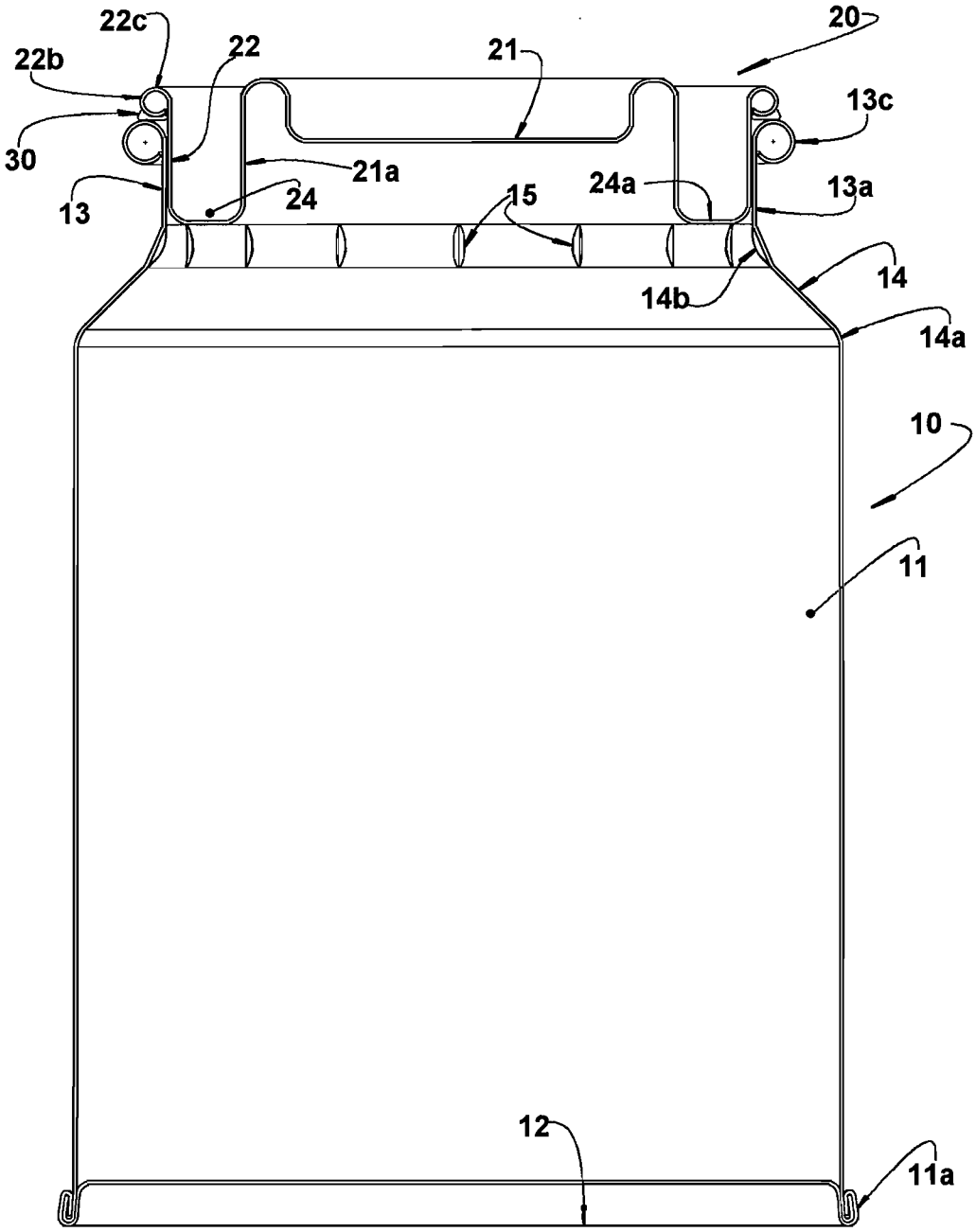
FIG. 1A represents a view similar to that of FIG. 1, but with the lid in a closed condition.
Figure 2:
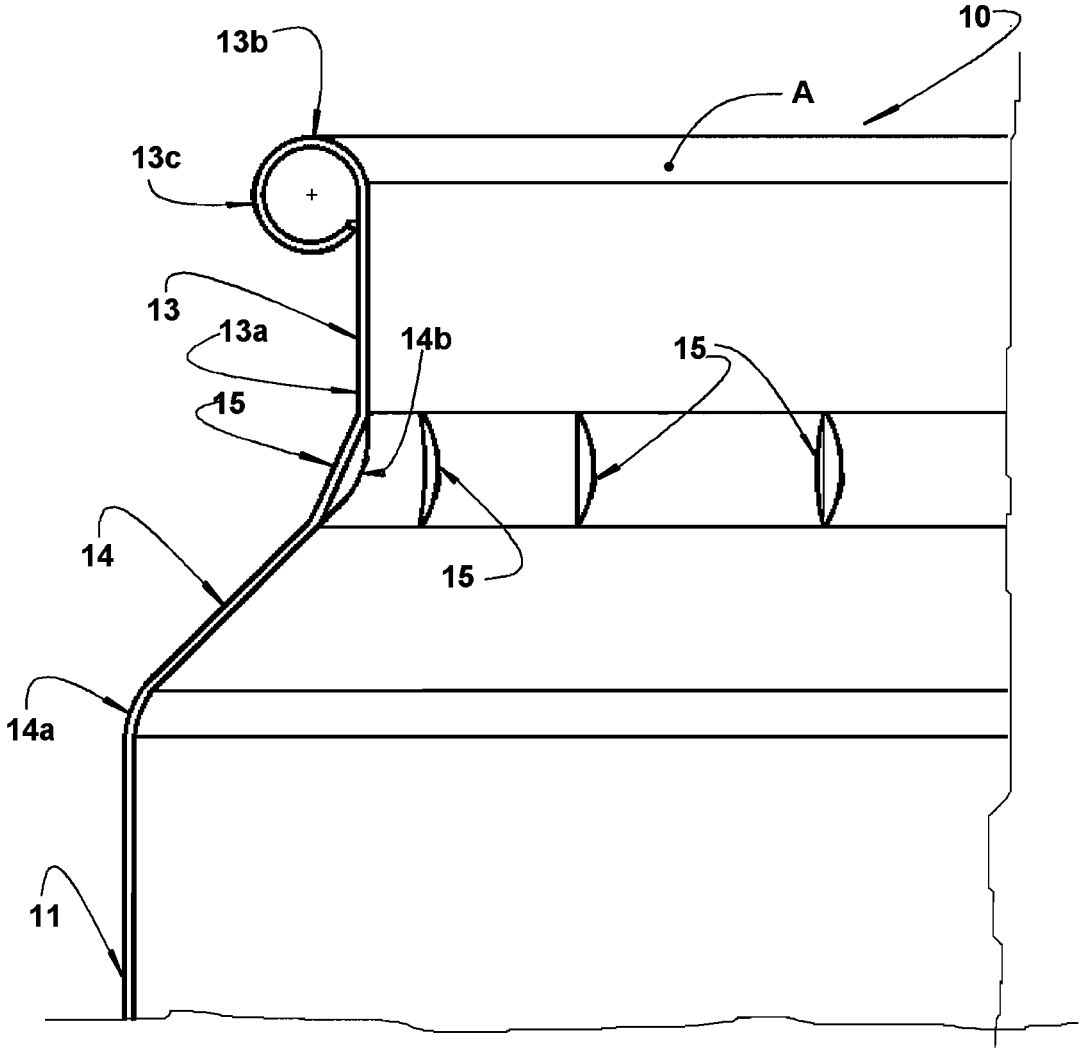
FIG. 2 represents an enlarged detail of part of FIG. 1, illustrating the formation of the longitudinal ribs in the transition portion.
Figure 3:
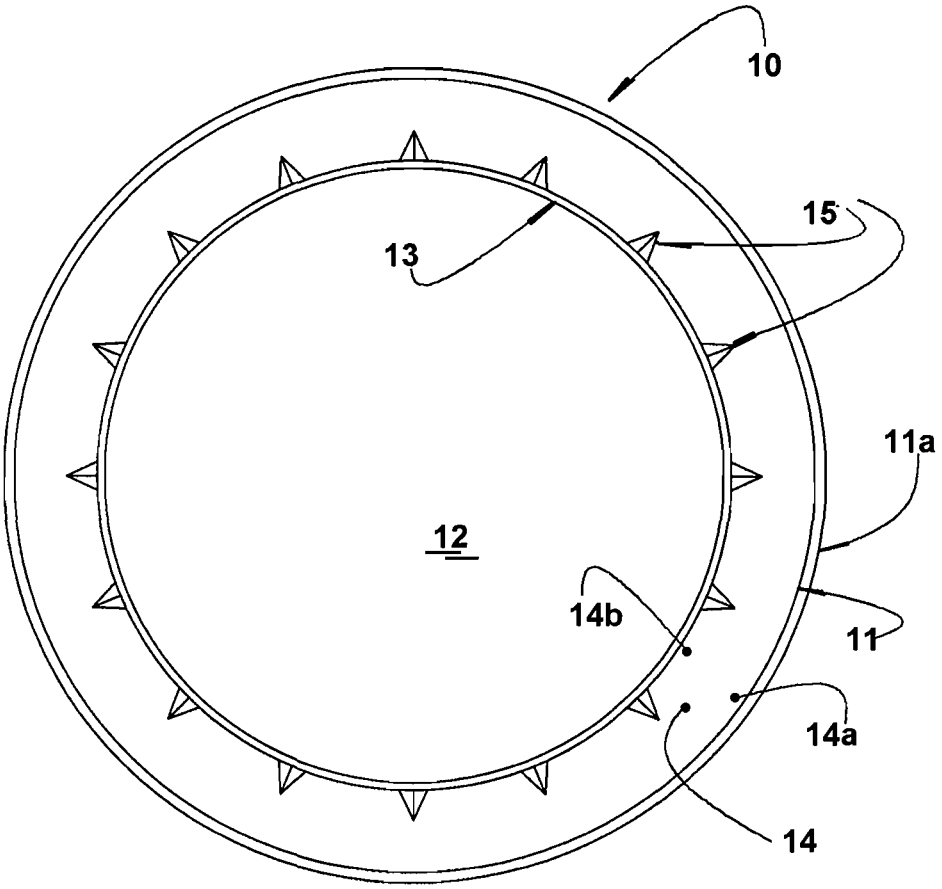
FIG. 3 represents a cross-sectional view of the neck portion of the can, taken according to line III-III in FIG. 1 and illustrating the arrangement of the longitudinal ribs.
Figure 4:
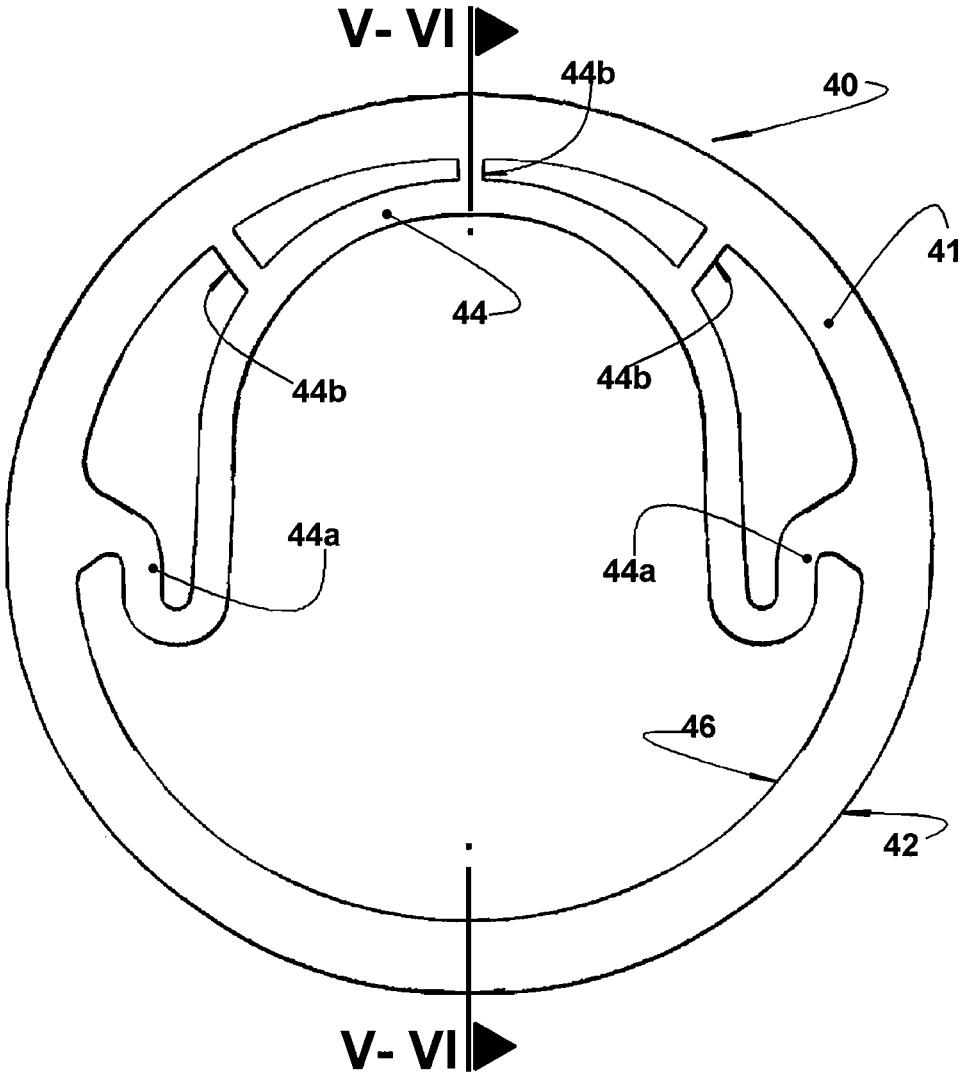
FIG. 4 represents a top plan view of a retaining ring to be applied to the can illustrated in FIGS. 1 and 1A.
Figure 5:
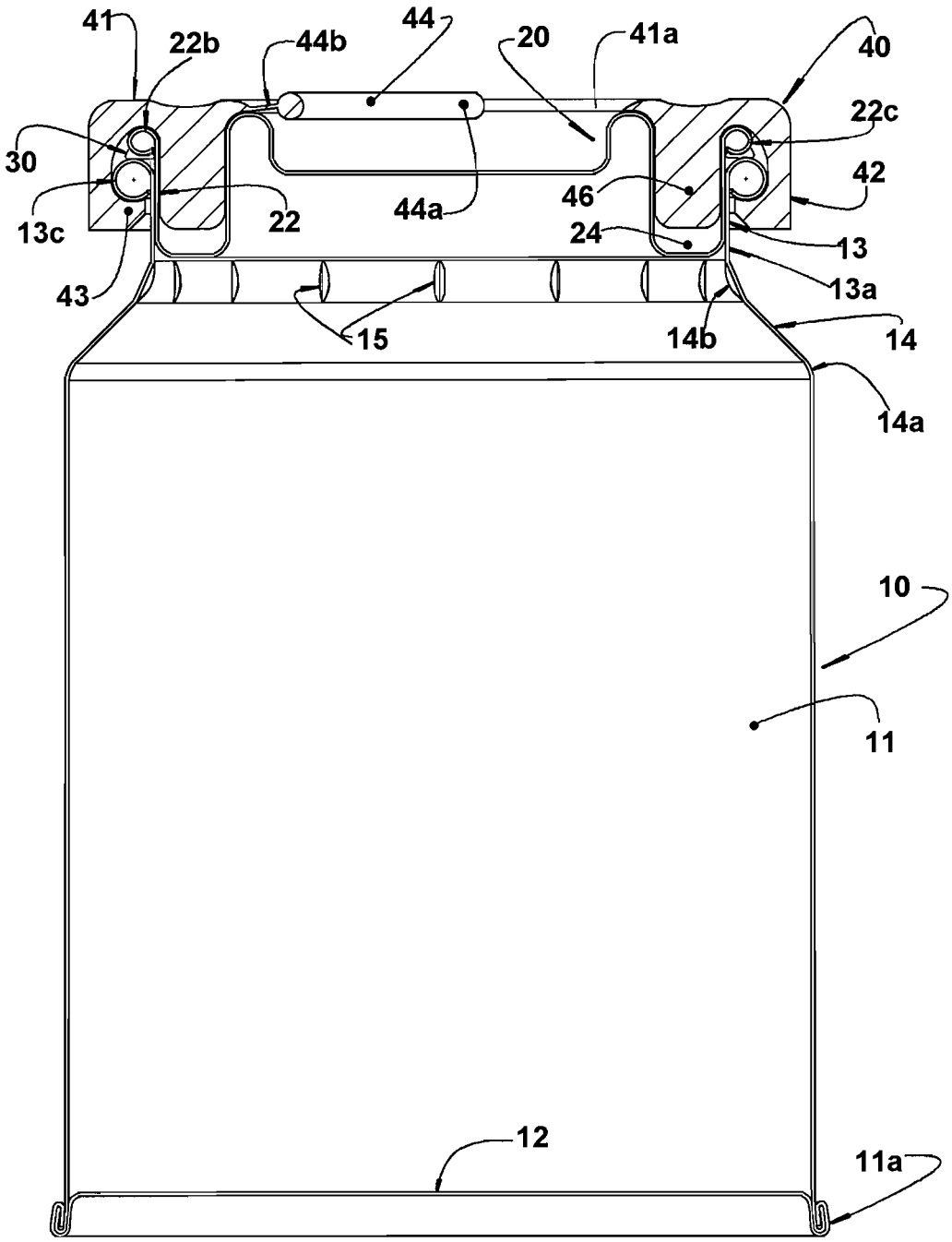
FIG. 5 represents a partial sectional view of the retaining ring when mounted on a can with closed lid, taken according to line V-V in FIG. 4.
Figure 6:
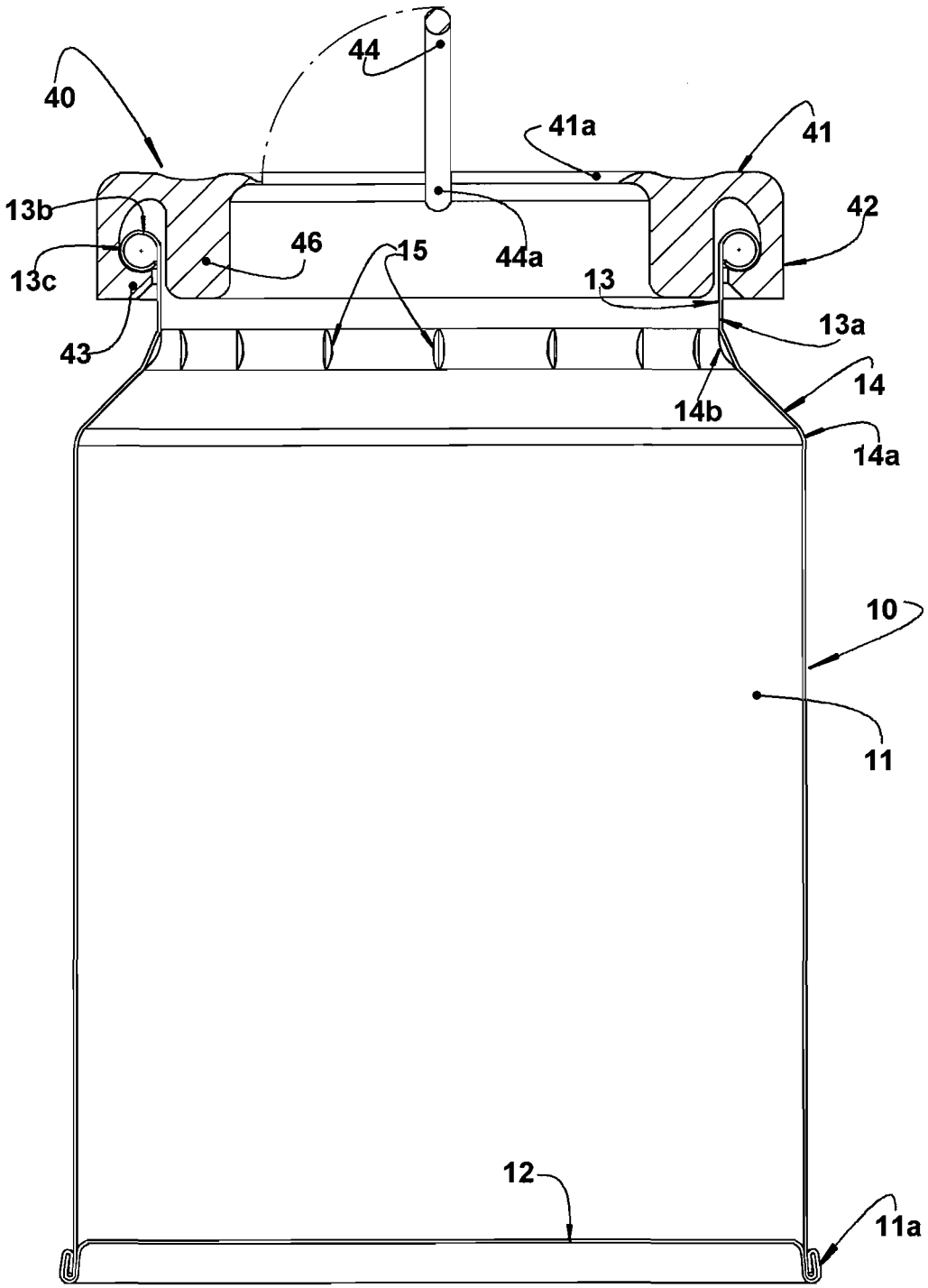
FIG. 6 represents a partial sectional view of the retaining ring when mounted on a can without the lid and with the suspension handle in the raised operative condition, taken according to line VI-VI in FIG. 4.

As already previously described and illustrated in the enclosed drawings, the improvements proposed by the invention are applied to a can 10 formed in metallic sheet, generally tinplate, presenting a generally circular cross-section, but which can be polygonal, although not being illustrated in the drawings.

The tubular shaped can 10 comprises: a body portion 11, in whose lower end edge 11*a* is affixed, generally by double-seaming, the peripheral edge of a bottom wall 12; a neck portion 13 having a concentrical contour, which is similar and reduced in relation to that of the body portion 11, and an upper end edge 13*b* defining the contour of an upper opening A for the can 10; and a transition portion 14 with a profile inclined in relation to the axis of the can 10 and joining the body portion 11 and the neck portion 13.

The upper end edge 13*b* of the neck portion 13 incorporates an outer peripheral projection 13*c*. In the illustrated condition, the outer peripheral projection 13*c* takes the form of a curl of tubular cross-section, obtained by bending the metallic sheet radially outwards in the region of the upper end edge 13*b*. In the drawings, the cross-section of the curl is circular, but it should be understood that a peripheral projection with different cross-sections, tubular or not, can be formed.

The formation of the body portion 11 is initiated by forming a tubular body with a cross-section corresponding to that of the neck portion 13, and which is then radially expanded along part of its height, to define the body portion 11 and the transition portion 14, under methods already known by the prior art, the transition portion 14 remaining inferiorly joined to the body portion 11 by a junction region in convex arc 14*a* and superiorly joined to the neck portion 13 by a junction region in concave arc 14*b*.

The can 10 further comprises a lid 20 formed in a single piece of stamped metallic sheet, presenting a panel portion 21 occupying great part of the cross-section area of the upper opening A and incorporating a peripheral tubular portion 22 that is configured and dimensioned to be tightly fitted, with interference, in the upper opening A, in the interior of the neck portion 13, this peripheral tubular portion 22 presenting a free upper edge 22*b* in which is incorporated an outer circumferential rib 22*c* configured to be seated onto the upper end edge 13*b* of the neck portion 13.

In the illustrated construction, the outer circumferential rib 22*c* takes the form of a curl of tubular cross-section, obtained by bending radially outwards from the region of the free upper edge 22*b* of the peripheral tubular portion 22. Although the drawings illustrate only a curl of circular section, it should be understood that an outer circumferential rib 22 with different cross-sections, tubular or not, can be formed.

According to a first aspect of the invention, the outer circumferential rib 22*c* inferiorly carries an annular gasket 30, preferably in the form of a resin washer, for example "Plastisol", molded under the outer circumferential rib 22*c* of the lid 20. When the lid 20 is fitted in the upper opening A of the neck portion 13, the annular gasket 30 is seated and pressed onto the upper end edge 13*b* of the neck portion, considerably increasing the tightness degree of the closure of the lid 20.

As illustrated, the lid 20 is preferably constructed with its panel portion 21 incorporating a pending skirt 21*a* which forms, with the peripheral tubular portion 22, a peripheral channel 24, of rectangular section, radially separating the panel portion 21 from the peripheral tubular portion 22, the panel portion 21 lying in a plane higher than that of the bottom wall 24*a* of the peripheral channel 24.

According to a second aspect of the invention, the shaping of the can 10 is made so that the transition portion 14 externally incorporates, in a single piece, a plurality of longitudinal ribs 15, angularly spaced from each other and joining the transition portion 14 to an adjacent lower region 13*a* of the neck portion 13.

The longitudinal ribs 15 can be formed by localized bendings of the metallic sheet that forms the body portion 11, the neck portion 13 and the transition portion 14, upwardly and inclinedly extending, like a bracket, from a median region of the transition portion 14 to the adjacent lower region 13*a* of the neck portion 13.

In the illustrated embodiment, the longitudinal ribs 15 have their extension limited or only slightly larger than the longitudinal extension of the cross-section of the junction region, in concave arc 14*b*, which joins the transition portion 14 to the neck portion 13.

The improved construction described above allows a retaining ring 40 to be adapted to the can 10, which retaining ring 40 is formed in a single piece of plastic material and comprises: an upper annular portion 41, to be seated onto the free upper edge 22*b* of the peripheral tubular portion 22 of the lid 20; a peripheral skirt portion 42 pending from the upper annular portion 41, laterally tightly surrounding the outer circumferential rib 22*c* of the lid 20 and the outer peripheral projection 13*c* of the body portion 11 and incorporating an inner circumferential finger 43 to be seated and axially locked under the outer peripheral projection 13*c* of the body portion 11, preventing the lid from being removed, without evidencing the necessary use of a lever tool supported in the outer peripheral projection 13*c*.

The retaining ring 40 has its upper annular portion 41 internally incorporating the diametrically opposed ends of a suspension handle 44 which is displaced between a retracted inoperative position, coplanar or considerably coplanar to the upper annular portion 41 and having a median portion 44*a* connected to the upper annular portion 41 by breakable bridges 44*b*, and a raised operative position, obtained after the rupture of the breakable bridges 44*b*.

In the illustrated constructive form, the retaining ring 40 also incorporates, in its upper annular portion 41, a lower tubular projection 46 that is dimensioned to be fitted, with interference, in the interior of the peripheral channel 24 of the lid 20, forcing the peripheral tubular portion 22 of the latter against the neck portion 13, increasing the axial locking between the lid 20 and the neck portion 13 and also the tightness degree in this closure region.

For example, when applied to contain paints, varnishes and similar products, the upper annular portion 41 can radially inwardly prolong in relation to the position of the lower tubular projection 46, to form a flap 41*a* for scraping brushes and broaches when, after the withdrawal of the lid 20, the retaining ring is reconducted to its axially locked position under the outer peripheral projection 13*c* of the neck portion 13, so that the can 10 can be suspended by the suspension handle 44 and so maintained while its content is progressively removed in a continuous painting operation.

The invention claimed is:

1. A can of the type which comprises, in metallic sheet;

a radially expanded body portion having a lower edge which carries a bottom wall;

a neck portion having a cross section contour, which is concentrical, similar and reduced in relation to that of the body portion, and an upper end edge which incorporates an outer peripheral projection and which defines the contour of an upper opening;

a transition portion with a profile that is inclined in relation to the axis of the can from the neck portion to the body portion, joining the body portion with the neck portion;

a lid presenting a panel portion which incorporates a peripheral tubular portion and a pending skirt which forms, with the peripheral tubular portion, a peripheral channel radially separating the panel portion from the peripheral tubular portion to be tightly fitted, with interference, in the interior of the upper opening of the neck portion and having a free upper edge along an upper portion of the lid carrying an outer circumferential rib to be seated onto the upper end edge of the neck portion, wherein the outer circumferential rib inferiorly carries, an annular gasket to be seated onto the upper outer edge of the neck portion upon the fitting of the lid on the upper opening; and a removable retaining ring configured as a single piece of plastic material and including:

an upper annular portion configured to be seated on the free upper edge of the lid, and a peripheral skirt portion pending from the upper annular portion, laterally tightly surrounding the outer circumferential rib of the lid and the outer peripheral projection of the body portion, and incorporating an inner circumferential finger configured to be seated under and axially locked by the outer peripheral projection of the neck portion, wherein the upper annular portion of the retaining ring incorporates a lower tubular projection to be fitted, with interference, in the interior of the peripheral channel of the lid, forcing the peripheral tubular portion of the latter against the interior of the neck portion of the can; and wherein the lower tubular projection is disposed below the upper annular portion.

2. The can, as set forth in claim 1, wherein the annular gasket is defined by a resin washer molded under the outer circumferential rib of the lid.

3. The can, as set forth in claim 1, wherein the transition portion externally incorporates, in a single piece, a plurality of spaced apart longitudinal ribs joining the transition portion to an adjacent lower region of the neck portion.

4. The can, as set forth in claim 3, wherein the longitudinal ribs have an extension limited to a junction region, in concave arc, of the transition portion with the neck portion.

5. The can, as set forth in claim 3, wherein the outer peripheral projection and the outer circumferential rib are defined by bending radially outwardly, from the upper end edge of the neck portion and from the free upper edge of the peripheral tubular portion of the lid, respectively.

6. The can, as set forth in claim 1 further comprising:

at least one suspension handle having opposite ends incorporated to the upper annular portion and being displaceable between a retracted inoperative position, coplanar to the upper annular portion and medianly connected thereto by breakable bridges, and a raised operative position obtained by the rupture of the breakable bridges.

7. The can, as set forth in claim 2 wherein the transition portion externally incorporates, in a single piece, a plurality of spaced apart longitudinal ribs joining the transition portion to an adjacent lower region of the neck portion.

8. The can, as set forth in claim 2 further comprising:

at least one suspension handle having opposite ends incorporated to the upper annular portion and being displaceable between a retracted inoperative position, coplanar to the upper annular portion and medianly connected thereto by breakable bridges, and a raised operative position obtained by the rupture of the breakable bridges.

9. The can, as set forth in claim 3 further comprising:

at least one suspension handle having opposite ends incorporated to the upper annular portion and being displaceable between a retracted inoperative position, coplanar to the upper annular position and medianly connected thereto by breakable bridges, and a raised operative position obtained by the rupture of the breakable bridges.

10. The can, as set forth in claim 4 further comprising:

at least suspension handle having opposite ends incorporated to the upper annular portion and being displaceable between a retracted inoperative position, coplanar to the upper annular portion and medianly connected thereto by breakable bridges, and a raised operative position obtained by the rupture of the breakable bridges.

11. The can, as set forth in claim 5 further comprising:

at least one suspension handle having opposite ends incorporated to the upper annular portion and being displaceable between a retracted inoperative position, coplanar to the upper annular portion and medianly connected thereto by breakable bridges, and a raised operative position obtained by the rupture of the breakable bridges.

* * * * *